US007658782B2

(12) United States Patent
Li et al.

(10) Patent No.: US 7,658,782 B2
(45) Date of Patent: Feb. 9, 2010

(54) LIME-BASED ADDITIVE FOR STEEL SMELTING AND THE PREPARATION METHOD THEREOF

(75) Inventors: Jizong Li, Qingdao (CN); Jaemu Kim, Aichi (JP); Hao Du, Qingdao (CN)

(73) Assignee: Qingdao Deshipu Metallurgy Science & Technology Co., Ltd., Qingdao (CN)

( * ) Notice: Subject to any disclaimer, the term of this patent is extended or adjusted under 35 U.S.C. 154(b) by 53 days.

(21) Appl. No.: 11/966,561

(22) Filed: Dec. 28, 2007

(65) Prior Publication Data

US 2008/0156146 A1 Jul. 3, 2008

(30) Foreign Application Priority Data

Dec. 30, 2006 (CN) ..... 2006 1 0156166

(51) Int. Cl.
*C22B 1/243* (2006.01)
*C22B 1/244* (2006.01)
*C22B 11/10* (2006.01)

(52) U.S. Cl. ..... 75/329; 75/766; 75/768; 75/771; 75/773

(58) Field of Classification Search ..... 75/325, 75/327, 329, 768, 773
See application file for complete search history.

(56) References Cited

U.S. PATENT DOCUMENTS 3,463,472 A * 8/1969 Worner ..... 266/162
RE30,488 E * 1/1981 Kreiger et al. ..... 75/773
5,912,403 A * 6/1999 Bilke ..... 75/773
6,803,105 B1 * 10/2004 Laudet et al. ..... 428/403
2002/0004099 A1 * 1/2002 Ando ..... 427/212
2005/0051156 A1 * 3/2005 Schreff et al. ..... 126/263.09

FOREIGN PATENT DOCUMENTS

CN 1743467 A * 3/2006
JP 10060431 A * 3/1998
JP 2004123504 A * 4/2004
JP 3750928 B * 12/2005

OTHER PUBLICATIONS

Weiss, SME Mineral Processing Handbook, 1985, Kingsport Press, vol. 1, p. 3A-4.*

* cited by examiner

*Primary Examiner*—Jerry Lorengo
*Assistant Examiner*—Jared Wood
(74) *Attorney, Agent, or Firm*—Blakely, Sokoloff, Taylor & Zafman LLP

(57) ABSTRACT

This invention belongs to ferrous metallurgy field, and in particular relates to a lime-based additive for steel smelting which is used in the electric furnace refining and steel casting process for carbureting and deoxidation and the preparation method thereof. The lime-based additive for steel smelting comprises lime-based material and carbonaceous material, wherein the content of the lime-based material is 40-80 wt % relative to the total amount of the additive, and the remaining is the carbonaceous material; the lime-based material is a passivated CaO powder with a low flowability, or the mixture of the passivated CaO powder and $CaCO_3$ powder, and the carbonaceous material is at least one of the coke, graphite, semi-coke powder and coal with carbon content not less than 85 wt %. When the additive has a shape of pellet, and it further comprises 1-5 wt % of agglomerant which has a microstructure of strip, streak or dendritic, and is at least one of MgO, $Al_2O_3$, and $CaCO_3$.

8 Claims, 1 Drawing Sheet

LIME-BASED ADDITIVE FOR STEEL SMELTING AND THE PREPARATION METHOD THEREOF

CROSS-REFERENCE TO RELATED APPLICATIONS

Figure 1:
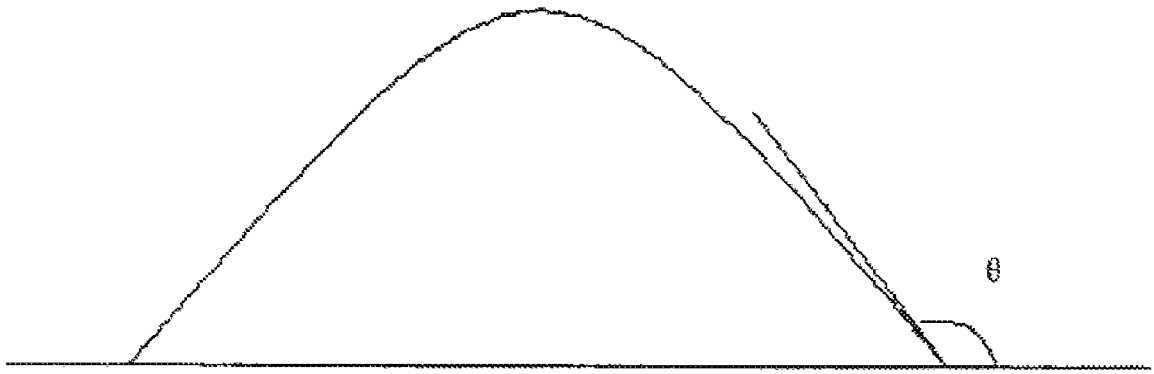

The present patent application claims priority from Chinese Patent Application No. 200610156166.8, filed on Dec. 30, 2006.

TECHNICAL FIELD

This invention belongs to ferrous metallurgy field, and in particular relates to lime-based carburetion additive which is used under the oxidization atmosphere during electric furnace refining and steel casting process and the preparation method thereof.

BACKGROUND OF THE ART

At present, there are mainly two steel smelting methods worldwide, 60-70% of which is the converter steel smelting with a long process flow, and the other is the electric furnace (also referred to as the electric furnace steel smelting process) with a short process flow. The main raw materials for the electric furnace smelting process are the scrap steel, and most of the industrial or municipal scrap steels are lightweight and thin sheets, with a low content of carbon (0.10~0.35%). Moreover, due to long-term storage in open air, most of the scrap steels have the surface rust, such that when smelting the scrap steels in the electric furnace, the carbon must be added in the charge depending on the requirements of carbon content for steel smelting. During the preparation of carbon, considering the fact that some carbon is fire lost and part of carbon must be also used in the reduction reaction with $Fe_2O_3$, the amount of carbon make-up is very high. Usually, the materials for adding the carbon include the pig iron, melted iron, blocky coke, waste graphite electrode or carbon-containing pellet, and the powdery carbonaceous materials are blown into the melted steel.

In the prior art, the carburetion additive for electric furnace smelting is materials with a carbon content more than 80%, including the common carbon-containing pellet etc, in addition to the molten iron or pig iron. For example, Japan Patent No. 3750928, (Application No. 2001-373378 filed on Dec. 8, 2001) disclosed a carburetion additive comprising 20-80% of lime-based materials and 20-80% of carbonaceous materials, and a steel smelting method. However, this additive can't be kept in open air for long period while keeping its performances, and it may be usually stored in open air for less than 7 days.

SUMMARY OF THIS INVENTION

An object of this invention is to provide an improved lime-based additive for steel smelting and the preparation method thereof, wherein the additive is suitably used in the electric furnace smelting or steel-casting and has the effects of carburet and deoxidation. The additive is powdery or has a shape of pellet, and is not apt to absorb moisture in the air such that the additive can be stored in the air for long-term while keeping its stability, and the pellet is not apt to be cracked or damaged, and has a low cost.

In order to realize the object above, the following technical solutions are provided in this invention:

Firstly, this invention provides a lime-based additive for steel smelting, which comprises lime-based material and carbonaceous material, wherein the content of the lime-based material is 40-80 wt % relative to the total amount of the additive, and the remaining is the carbonaceous material; the lime-based material is a passivated CaO powder with a low flowability, or the mixture of the passivated CaO powder and $CaCO_3$ powder, and the carbonaceous material is at least one of the coke, graphite, semi-coke powder and coal with carbon content not less than 85 wt %.

Secondly, this invention provides a preparation method of lime-based additive for steel smelting, which includes the steps of raw material crushing and mixing, to manufacture the powdery additive, wherein:

(1) the raw materials include the lime-based material and carbonaceous material, the content of lime-based material is 40-80 wt % relative to the total amount of the raw materials, and the remaining is the carbonaceous material; the lime-based material is a passivated CaO powder with a low flowability, or the mixture of the passivated CaO powder and $CaCO_3$ powder, and the carbonaceous material is at least one of coke, graphite, semi-coke powder and coal with carbon content not less than 85 wt %; and (2) the raw materials are crushed into particles having a plurality of edges or being dendritic, with a particle size of 0.0005-1.0 mm.

Thirdly, this invention provides another preparation method of lime-based additive for steel smelting, which includes the steps of raw material crushing, mixing and pressing, to manufacture the pellet additive, wherein:

(1) the raw materials include the lime-based material, carbonaceous material and agglomerant, relative to the total amount of the raw materials, the content of lime-based material is 40-80 wt %, the content of the agglomerant is 1-5 wt %, and the remaining is the carbonaceous material; the lime-based material is a passivated CaO with a low flowability, or the mixture of the passivated CaO powder and $CaCO_3$ powder, the carbonaceous material is at least one of the coke, graphite, semi-coke powder and coal with carbon content not less than 85 wt %, and the agglomerant has a microstructure of strip, streak or dendritic, and is at least one of MgO, $Al_2O_3$, and $CaCO_3$;

(2) the raw materials are crushed into particles having a plurality of edges or being dendritic, with a particle size of 0.0005-1.0 mm; and (3) the particle size of the pellet is 10 mm-60 mm.

In particular, the additive according to this invention may be prepared into powder or pellet. The main technical solutions of the present invention include the following aspects:

Cao in the Main Raw Material is a Passivated Powder with a Low Flowability.

A waterproof film is attached onto the surface of the passivated CaO powder. The waterproof film may be formed by one of mineral oil, vegetable oil and silicon oil. The silicon oil belongs to one of AF surface modifier.

One of the main raw materials for this invention, CaO (lime), is a lime subjected to physical passivation, and after the lime is surface passivated, it is prevented from reacting with moisture in the air or in other raw materials as follows: $CaO+H_2O=Ca(HO)_2$. On the contrary, if the calcium hydroxide is generated, the finished pellet may be cracked and damaged due to the volume dilatation, and the hydrogen content in steel may be increased in steel smelting process, since the reverse reaction, i.e., the decomposition reaction may occur above 500° C. The passivation of the lime is carried out by uniformly attaching a thin layer of waterproof film onto the surface of pulverized lime particles in order to prevent the lime from directly contacting with the moisture. Hydrophobic inorganic or organic compounds, such as various mineral oils, vegetable oils, and silicon oils etc, may be attached onto the surface of the lime particles. As seen in FIG. 1, this passivated lime has an angle θ of repose being <120°, indicating that its flowability is low. The pellet made of passivated lime may not absorb the moisture, and may be stored for more than 30 days, while the additive of the prior art may be stored only within 7 days.

The amount of the waterproof film is 0.05-0.15 wt % of the CaO powder. If the amount is <0.05%, the necessary passivation effect can't be realized. If the amount is >0.15%, the cost will increase, and cause the adverse influences on the steel smelting.

When the lime-based materials are the mixture of the CaO powder and $CaCO_3$ powder, the $CaCO_3$ powder is 10-20 wt % of the lime-based materials.

The semi-coke powder is a coke obtained by retorting the high volatile coal at 1000° C. or above, and its specific resistance is higher than that of a common coke.

The content of sulfur in the coal with carbon content not less than 85 wt % is less than 0.2 wt %.

For the preparation of pellet additive, this invention further includes:

The Main Raw Material is the Irregular Particles.

The raw material may be crushed into irregular, streaky or dendritic particles with a plurality of edges using at least one of the Raymond crusher, jet mill, and spiral crusher in order to be then pressed into the required pellet. The particle size of lime-based materials and/or carbonaceous material may be 0.0005-1.0 mm.

Add a Small Amount of Agglomerant with a Non-Spherical Microstructure

When this additive has a shape of pellet, it further comprises 1-5 wt % of agglomerant, which has a non-spherical microstructure, such as strip, streak or dendritic. As the mechanically filled agglomerant, the agglomerant is 1-10 μm long, and has a cross section of Φ0.1-1 μm. The particle size and shape of the agglomerant is different from that of the main raw materials. This microstructure may effectively ensure the required results even only a small amount (1-5 wt %) of agglomerant is used. If the amount of the agglomerant is >5%, the procedures (agitation and uniform mixing) shall be added, the cost will increase, and the content of useful materials will be reduced. If the amount of the agglomerant is <1%, the cementing function can't be realized. The agglomerant may be a metal oxide or carbonate, such as at least one of MgO, $Al_2O_3$ and $CaCO_3$.

The preparation method of lime-based additive for steel smelting according to this invention is as follows: the raw materials are formulated firstly according to the chemical composition of the additive, and then the raw materials are uniformly mixed into the powdery lime-based additive for steel smelting. Alternatively, the uniformly mixed materials containing agglomerant is fed in a high pressure roll-type pelletizer to be pressed into the pellet, that is, the pellet lime-based additive for steel smelting.

Among the raw materials with the chemical composition mentioned above, the lime-based materials may generate the high alkali slag, improve and promote the molten steel to absorb the carbon. The calcium carbonate may be decomposed at 980° C. according to the formula below:

$$CaCO_3 = CaO + CO_2$$

The $CO_2$ generated during the decomposition of calcium carbonate agitates the molten steel such that the local chemical reaction may be speeded up and optimized, and the molten steel is promoted to absorb carbon.

During the conventional electric furnace smelting, in order to desulfurize and dephosphorize, the lime may be added for slagging, which is separately added with carburant, so the contact points between CaO molecule in lime and carbon atom are very few. However, in this invention, due to fine size of lime-based additive for steel smelting, the CaO molecule is fully mixed with the carbon atom, so the multiple contact points and adequate contact may be realized between the two materials. As a result, at the time of deoxidizing, the lime-based additive for steel smelting according to this invention may promote and stably increase the content of carbon in steel, and this reaction is carried out under the oxidization atmosphere in electric furnace.

The carbonaceous materials in the lime-based additive for steel smelting are mainly used for the supply of carbon for steel smelting, that is, the carbureting demand.

The agglomerant in the lime-based additive for steel smelting is used for connecting and cementing the lime-based molecules and carbon element in the pellet additive for steel smelting.

In this invention, the lime-based materials and carbon-containing materials are used as the main raw materials to obtain the pellet or powder materials. The lime in this lime-based additive for steel smelting is specially treated. The moisture-proof pellet or powder materials may be stored in air for long period while keeping its performance without cracks or damages. This lime-based additive for steel smelting may ensure the stable carbureting of molten steel under the oxidization atmosphere, and the content of carbon in molten steel may be controllable.

Compared with the prior art, the lime-based additive for steel smelting according to this invention has the following advantages:

1. The lime-based additive for steel smelting may not only significantly and steadily carburet the molten steel, but also eliminate the free and compound oxygen in molten steel, so the steel is improved in terms of the steel cleanness and toughness.

2. The lime-based additive for steel smelting is easy to store, pack, transport and use, and keeps its performances within a long term.

3. Compared with the same type products, the lime-based additive for steel smelting according to this invention is advantageous in that its raw material is available and low in cost.

BRIEF DESCRIPTION OF THE ACCOMPANYING DRAWINGS

FIG. 1 illustrates the angle θ of repose of the passivated lime-based material, wherein θ<120°.

PREFERRED EMBODIMENTS FOR CARRYING OUT THIS INVENTION

According to the chemical composition shown in Table 1, four batches of lime-based additives for steel smelting were prepared, in which, the second and the fourth batches were the powdery additive, and the first and the third batches were pellet additive.

Powdery Additive

According to the chemical composition shown in Table 1, the carbon-containing material, CaO and $CaCO_3$ were respectively crushed into irregular powder with the particle size less than 1 mm, using the Raymond crusher. CaO was passivated by the vegetable oil, that is, 0.1 wt % vegetable oil was added into the crushed CaO powder, and well mixed to attach a waterproof film onto the surface of the CaO powder. Then all materials mentioned above were mixed to obtain the required additive powder.

Pellet Additive

According to the chemical composition shown in Table 1, the carbon-containing material, CaO and $CaCO_3$ were respectively crushed into irregular powder with the particle size of 0.005-0.5 mm, using the jet mill. CaO was passivated by the silicon oil, that is, 0.3 wt % AF-IV silicon oil was added into the crushed CaO powder, and well mixed to attach a waterproof film onto the surface of CaO powder. The agglomerant was crushed with a non-ball mill to get the dendritic or strip agglomerant powder, the agglomerant powder was 1-10 μm long, and had the cross section of Φ0.1-1 μm. The agglomerant powder was different from main raw material in terms of the particle size and shape. Then the materials mentioned above were uniformly mixed, and pressed into pellet with high pressure roll-type pelletizer to get the required pellet additive.

TABLE 1

Chemical composition of lime-based additives for steel smelting in the examples of this invention (wt %)

| No. | Lime-based materials | | Carbon-containing materials | | Agglomerant | | State of the additive | CaO passivation |
|---|---|---|---|---|---|---|---|---|
| 1 | CaO | 45 | Coke | 53 | $CaCO_3$<br>$Al_2O_3$ | 1<br>1 | Pellet | AF-IV silicon oil 0.3 wt % |
| 2 | CaO<br>$CaCO_3$ | 45<br>3 | Graphite | 52 | — | | Powder | Vegetable oil 0.1 wt % |
| 3 | CaO | 40 | Semi-coke powder | 57 | $CaCO_3$<br>MgO | 2<br>1 | Pellet | AF-IV silicon oil 0.3 wt % |
| 4 | CaO<br>$CaCO_3$ | 50<br>5 | Coke | 45 | — | | Powder | Vegetable oil 0.1 wt % |

In the examples mentioned above, in the powdery additives, the particle size of materials was <0.5 mm; in the pellet additive, the particle size of the main material was <0.01 mm, and the agglomerant was 8-10 μm long, and had the cross section of Φ0.5-1 μm.

The carbureting effect of the additives was measured through the following method:

In this test, an AC electric furnace with the nominal volume of 50 t, and electric power of 30000 KVA was used. 25 t scrap steel was added into the electric furnace, meanwhile, about 0.5 t additive of this invention was added thereto (the amount of the additive added was adjusted according to the quality and type of the scrap steel, see Table 2 for details). The electric furnace was powered on for about 40 minutes to obtain 55 t molten scrap steel in total, the molten scrap steel was sampled after the slag was removed to measure the content of carbon therein. The results were shown in Table 2.

TABLE 2

Carbureting test results of additives for steel smelting in the electric furnace

| No. | | Volume of electric furnace (t) | Amount of the additives added (kg/t) | Content of carbon in molten steel when smelting the scrap steel (%) |
|---|---|---|---|---|
| This invention | 1 | 50 | 8.8 | 0.32 |
| | 2 | 50 | 9.0 | 0.29 |
| | 3 | 50 | 10.0 | 0.30 |
| | 4 | 50 | 11.0 | 0.27 |
| Prior art | Pig iron | 50 | 56 | 0.26 |
| | Blocky coke | 50 | 6.0 | 0.23 |

What is claimed:

1. A lime-based additive for steel smelting, which comprises a lime-based material and a carbonaceous material, wherein the content of the lime-based material is 40-80 wt % relative to the total amount of the additive, and the remaining is the carbonaceous material; the lime-based material is a passivated CaO powder with a low flowability, or a mixture of the passivated CaO powder and $CaCO_3$ powder, and the carbonaceous material is at least one of the coke, graphite, semi-coke powder and coal with carbon content not less than 85 wt %; and wherein the additive has a shape of pellet, and it further comprises 1-3 wt % of agglomerant which has a microstructure of strip, streak or dendritic, and is at least one of MgO, $Al_2O_3$, and $CaCO_3$.

2. The additive according to claim 1, wherein the angle θ of repose of the passivated CaO powder is <120°.

3. The additive powder of claim 1, wherein the passivated CaO powder comprises a waterproof film attached onto the surface of a CaO powder, the waterproof film is formed by any one of mineral oil, vegetable oil and silicon oil, and the amount of the water-proof film is 0.05 wt %-0.15 wt % of CaO.

4. The additive according to claim 1, wherein the agglomerant is 1-10μm long, and has a cross section of ϕ0.1-1μm.

5. The additive according to claim 1, wherein the particle size of the lime-based material and/or carbonaceous material is 0.0005-1.0 mm.

6. A preparation method of lime-based additive for steel smelting, which includes the steps of raw material crushing, mixing and pressing, to manufacture the pellet additive, wherein:

(1) the raw materials include a lime-based material, carbonaceous material and agglomerant, relative to the total amount of the raw materials, the content of lime-based material is 40-80 wt %, the content of the agglomerant is 1 3wt % and the remaining is the carbonaceous material; the lime-based material is a passivated CaO with a low flowability, or the mixture of the passivated GaO powder and $CaCO_3$ powder, the carbonaceous material is at least one of the coke, graphite, semi-coke powder and coal with carbon content not less than 85 wt %, and the agglomerant has a microstructure of strip, streak or dendritic, and is at least one of MgO, $Al_2O_3$, and $CaCO_3$;

(2) the raw materials are crushed into particles having a plurality of edges or being dendritic, with a particle size of 0.0005-1.0 mm; and (3) the particle size of the pellet is 10mm-60mm.

7. The method according to claim 6, wherein a waterproof film is attached onto the surface of a CaO powder to product the passived CaO powder, the waterproof film is formed by any one of mineral oil, vegetable oil and silicon oil, and the amount of the waterproof film is 0.005 wt %-0.015 wt % of CaO.

8. The method according to claim 6, wherein the raw materials are crushed into irregular streaky or dendritic particles with a plurality of edges using at least one of the Raymond crusher, jet mill, and spiral crusher.

* * * * *